US007070512B2

(12) United States Patent
Nishio

(10) Patent No.: US 7,070,512 B2
(45) Date of Patent: Jul. 4, 2006

(54) GOLF CLUB

(75) Inventor: Masayoshi Nishio, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/453,513

(22) Filed: Jun. 4, 2003

(65) Prior Publication Data

US 2004/0009830 A1 Jan. 15, 2004

(30) Foreign Application Priority Data

Jun. 4, 2002 (JP) ..... 2002-163321

(51) Int. Cl.
*A63B 53/10* (2006.01)
*A63B 53/04* (2006.01)

(52) U.S. Cl. ..... 473/319; 473/345

(58) Field of Classification Search ..... 473/345–346, 473/349, 314, 316–323
See application file for complete search history.

(56) References Cited

U.S. PATENT DOCUMENTS 5,439,219 A * 8/1995 Vincent ..... 473/319
5,916,038 A * 6/1999 Uchiyama et al. ..... 473/290
6,254,494 B1 * 7/2001 Hasebe et al. ..... 473/349

FOREIGN PATENT DOCUMENTS

JP 10-216272 A 8/1998
JP 11-9732 * 1/1999

* cited by examiner

*Primary Examiner*—Stephen Blau
(74) *Attorney, Agent, or Firm*—Birch, Stewart, Kolasch & Birch, LLP

(57) ABSTRACT

A golf club comprises a club shaft and a hollow club head, wherein the club head has a loft angle of from 14 to 18 degrees, a head volume of not less than 250 cc, and a sweet spot at a vertical distance of from 1 to 5 mm downwards of a face center, and the club shaft has a variable flexural rigidity whose minimum is in a range of from 5 to 10 N·m$^2$, and the minimum flexural rigidity occurs in a range between 0% and 40% of the length of the club shaft from the end of the club shaft.

6 Claims, 6 Drawing Sheets

GOLF CLUB

BACKGROUND OF THE INVENTION

The present invention relates to a golf club, more particularly to a combination of a club head having a specific geometry and a club shaft having a specific variable flexural rigidity, which can increase the traveling distance of the ball.

In case of golfers whose club head speed at impact is high such as pro golfers and advanced golfers, in order to obtain a high trajectory to increase the traveling distance of the ball, a sufficient backspin may be given to the ball even by a golf club having a relatively small loft angle, for example a driver having a loft angle of less than 11 degrees. An ideal driver shot trajectory may be obtained when the backspin is about 2000 rpm and the launch angle is about 12 degrees.

On the other hand, for the golfers whose club head speed at impact is relatively slow such as beginner golfers and intermediate golfers, it is very difficult to get a sufficient backspin with a golf club having a relatively small loft angle such as driver, and therefore, it is difficult to obtain a high trajectory and long traveling distance.

According to a ball hitting test using a swing robot conducted by the inventor, at the club head speed of the average golfers which is about 40 m/s, optimal conditions by which the traveling distance becomes maximum are a launch angle in the range of 14 to 17 degrees, and a backspin in the range of 1700 to 2500 rpm.

In order to increase the launch angle, the drivers for the average golfers are increased in the loft angle in comparison with the drivers for the advanced golfers as an established practice. The average golfers are however, more likely to hit a ball at a position under the sweet spot as the sweet spot shifts toward the top of the clubface with the increase in the loft angle. As a result, the backspin becomes excessively increased by the gear effect, which results in an undesired high trajectory to decrease the carry and run.

SUMMARY OF THE INVENTION

It is therefore, an object of the present invention to provide a golf club, in which the traveling distance can be increased even at a slow head speed.

According to the present invention, a golf club comprises a club shaft and a club head, the club head having a loft angle of from 14 to 18 degrees, a head volume of not less than 250 cc, and a sweet spot at a vertical distance of from 1 to 5 mm downwards of a face center, and the club shaft having a variable flexural rigidity whose minimum in a range of from 5 to 10 $N \cdot m^2$, the minimum flexural rigidity lying in a range between 0% and 40% of the length of the club shaft from the end of the club shaft.

DESCRIPTION OF THE PREFERRED EMBODIMENTS

Figure 1:
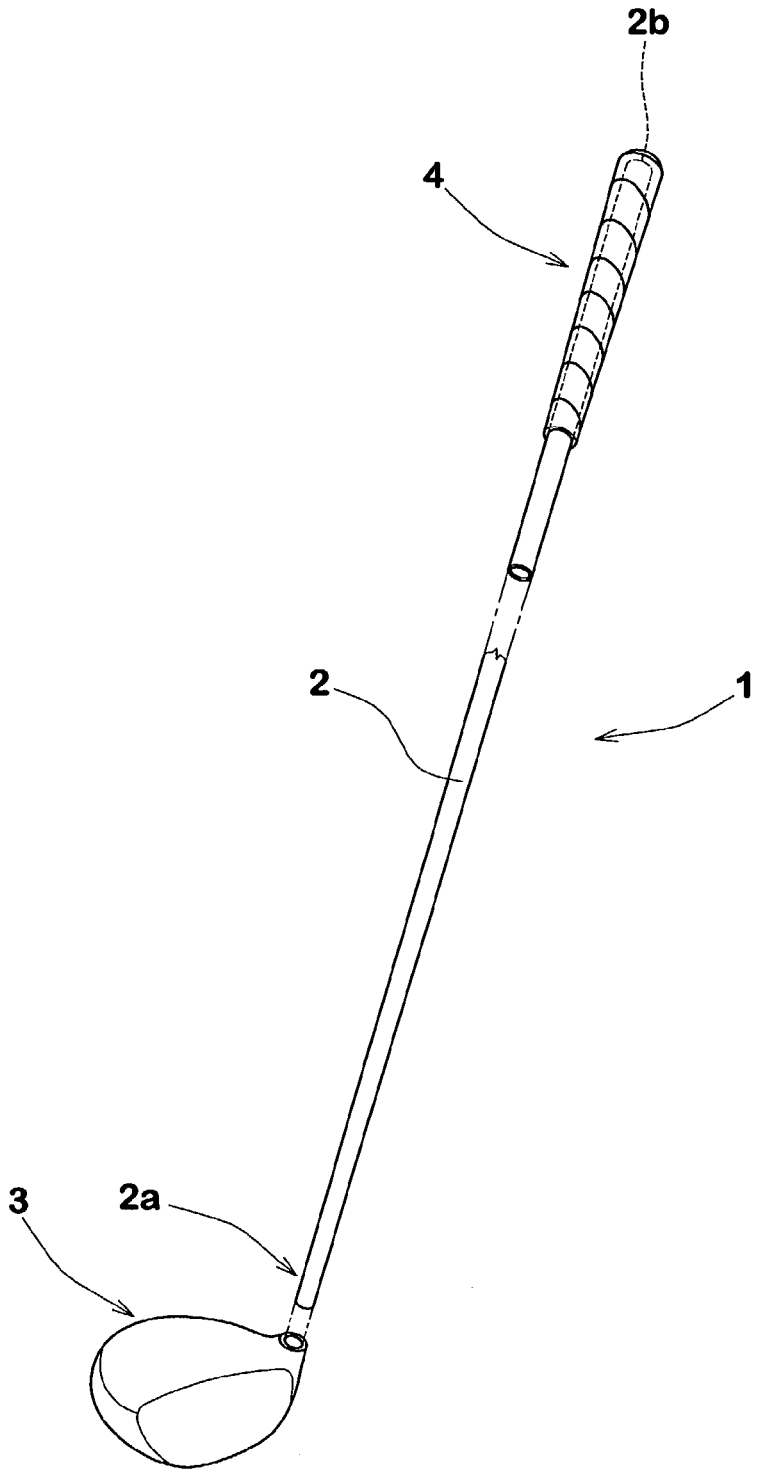
FIG. 1 is a wood-type golf club according to the present invention.

Embodiments of the present invention will now be described in detail in conjunction with the accompanying drawings.

In the drawings, golf club 1 according to the present invention is a wood-type golf club (#1 driver) comprising a round tubular club shaft 2 provided with a grip 4, and a wood-type hollow metallic club head 3 attached to the end 2*a* of the club shaft 2.

The length of the club 1 is in the range of 43 to 48 inches, preferably 43 to 47 inches.

The volume of the club head 3 is set in the range of not less than 250 cc, preferably more than 270 cc, more preferably more than 300 cc, but less than 500 cc, more preferably less than 450 cc.

The club head 3 comprises a face portion 3*a* whose front face defines a clubface F for striking a ball, a crown portion 3*b* intersecting the clubface F at the upper edge Ea thereof, a sole portion 3*c* intersecting the clubface F at the lower edge Eb thereof, a side portion 3*d* between the crown portion 3*b* and sole portion 3*c* which extends from a toe-side edge Ec to a heel-side edge Ed of the clubface F through the back face of the club head, a neck portion 3*e* to be attached to the end 2*a* of the club shaft 2.

Figure 2:
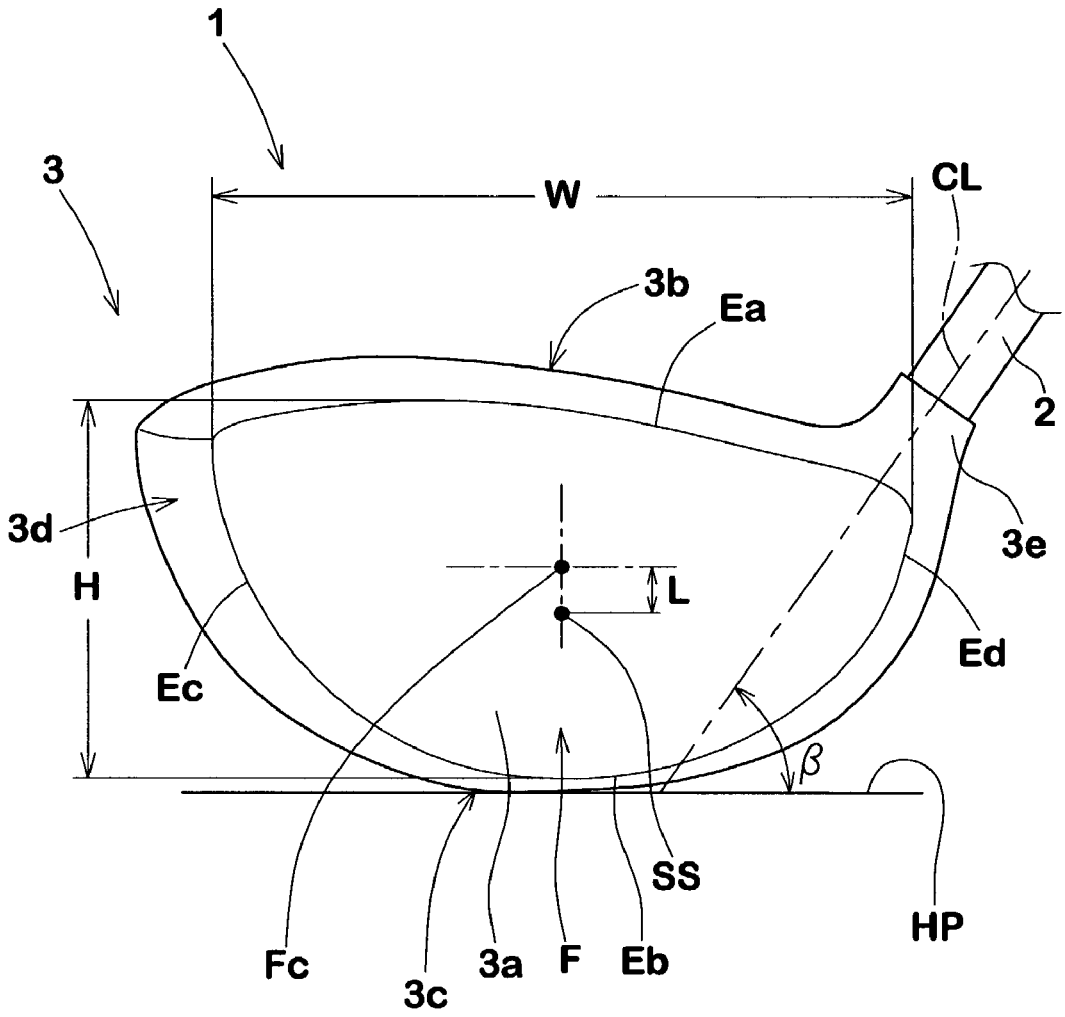
FIG. 2 is a front view of the club head thereof.
Figure 3:
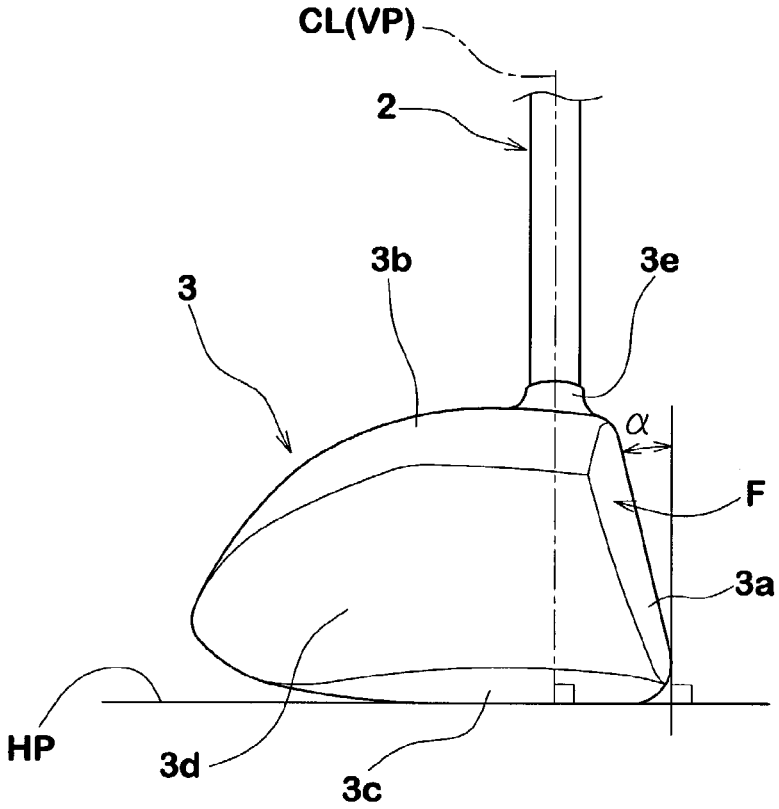
FIG. 3 is a toe-side side view of the club head.
Figure 4:
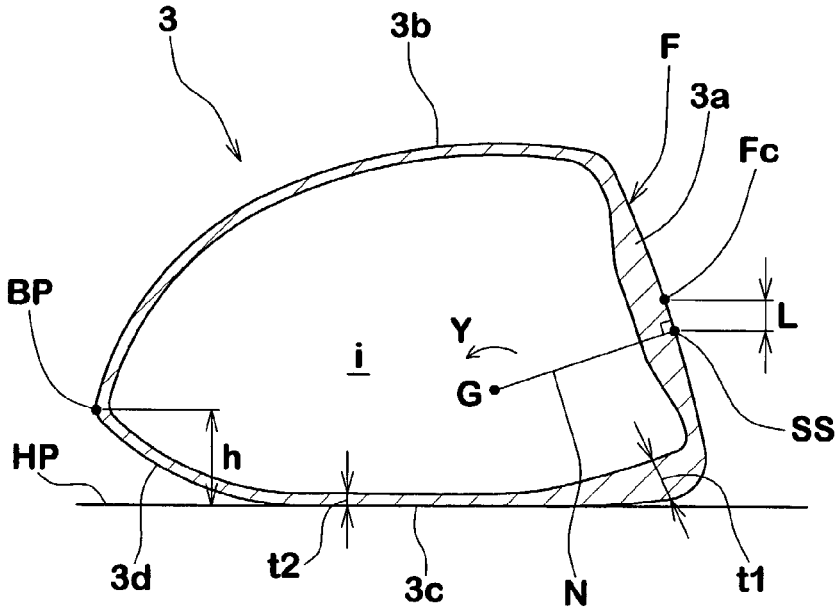
FIG. 4 is a cross sectional view of the club head taken along a vertical plane including the gravity point G.

In FIGS. 2, 3 and 4, the club head 3 is under its standard measuring state or conditions, wherein the club head 3 is set on a horizontal plane HP with the club shaft center axis CL inclined at the lie angle β within a vertical plane VP and the clubface inclined at the loft angle α and the face angle.

The loft angle α is set in the range of from 14 to 18 degrees, preferably 15 to 17 degrees. Here, the loft angle α is the so called real loft angle, not the original loft angle. When the clubface F is slightly curved as in this embodiment, the loft angle α is defined as a measurement at the face center Fc in this specification.

The face center Fc is, as shown in FIG. 2, defined as the middle point of both of the horizontal width W and vertical height H of the clubface F.

The sweet spot SS positioned under the face center Fc at a distance L of form 1 to 5 mm, preferable 1 to 4 mm in the vertical direction. In this example, the sweet spot ss is substantially aligned on a vertical line passing the face center Fc, viewed from clubface side as show in FIG. 2. However, such a vertical alignment is not always necessary. The sweet spot SS may be dislocated towards the heel or toe.

Here, the sweet spot ss is, as shown in FIG. 4, defined as a point of intersection between the clubface F and a straight line drawn from the gravity point G of the club head normally to the clubface F.

By setting the sweet spot position lower than the face center Fc, when a ball hits at the face center Fc above the sweet spot (many golfers will make an attempt to do so), the club head is rotated by a very small angle around the gravity point G in a direction Y shown in FIG. 4, and a frictional force which may decrease the backspin occurs due to gear effect. As a result, viewed as a whole, the backspin is optimized, and an unintended high trajectory may be prevented.

In order to lower the sweet spot SS as above and also to lower the gravity point G and further to bring the gravity point G close to the clubface, as shown in FIG. 4, the sole portion 3*c* is made thicker near the face portion 3*a* than the backside. The thicker portion in this example is formed along the front edge, continuously between the toe and heel.

In the thicker front edge portion, the thickness progressively increases, staring from a position beneath the gravity point G to a position immediately inside the face portion 3*a*.

The maximum thickness t1 in the thicker portion is limited in the range of about 3 mm to about 6 mm, preferably about 4 mm to about 5 mm. The thickness t2 in the rear portion of the thicker portion is set in the range of not less than 0.5 mm but not more than 2 mm, preferably not more than 1.5 mm. The thickness ratio (t1/t2) is preferably set in the rage of 1.5 to 12, more preferably 8 to 10 in order to achieve an effective gravity point shift. It is also possible to adjust the gravity point position by using a separate weight made of a large specific gravity metal and the like alone or in combination with the increase in the wall thickness.

Also it will be effective for lowering the gravity point G to limit the height (h) of the extreme back end BP of the club head in a range of from 5 to 30 mm, preferably 5 to 20 mm from the horizontal plane HP as shown in FIG. 4.

According to the present invention, the club head 3 having the sweet spot position lowered as described above, is combined with the club shaft 2 whose flexural rigidity is lowered near the club head 3.

The club shaft 2 has its smallest flexural rigidity in a tip end part which is defined as extending between 0% and 40% of the length of the club shaft from the tip end 2*a*.

The smallest flexural rigidity value is set in the range of not less than 5, preferable not less than 6.5, more preferable not less than 7.0 $N \cdot m^2$ but not more than 10, preferable not more than 8.5, more preferable not more than 8.0 $N \cdot m^2$.

The flexural rigidity of the club shaft 2 can be found by multiplying the elastic modulus E of the material of the club shaft 2 and the geometrical moment of inertia I.

In case the club shaft 2 is a round tube as in this embodiment, the geometrical moment of inertia I can be obtained by calculating $$I=\pi(D^4-d^4)/64$$

wherein, $\pi$ is the circle ratio,

D is the outside diameter of the club shaft, and d is the inside diameter of the club shaft.

Figure 5:
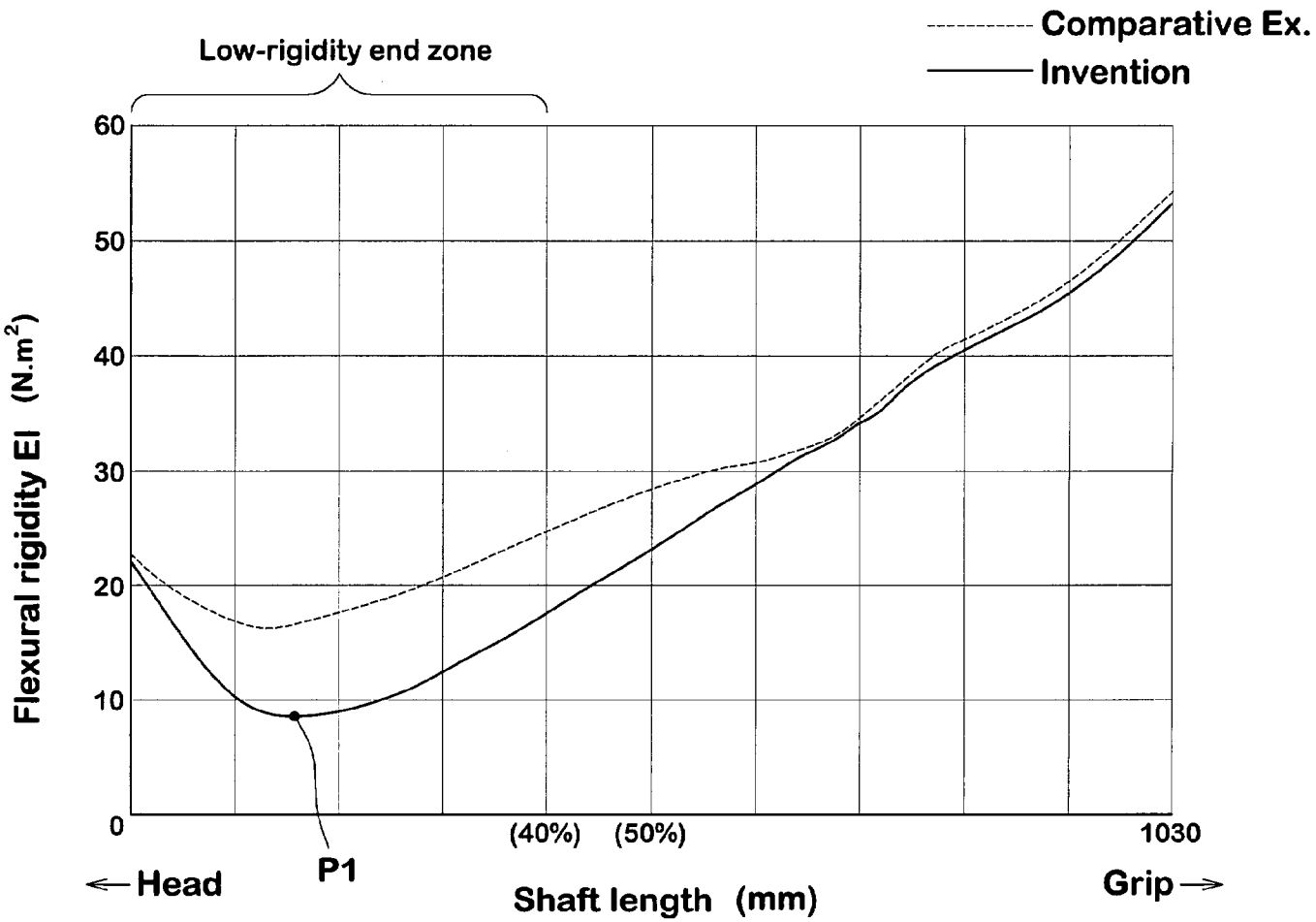
FIG. 5 is a graph showing a flexural rigidity variation as a function of the club shaft length.

FIG. 5 shows an example of the distribution or variation of the flexural rigidity of the club shaft in the longitudinal direction as a function of the relative longitudinal position on the club shaft, obtained by computing the product (E·I), together with the flexural rigidity variation of a commercially available club shaft obtained by instrumentation.

To realize such a variation, the club shaft 2 in this example is formed by winding up prepreg pieces around a mandrel.

Figure 6:
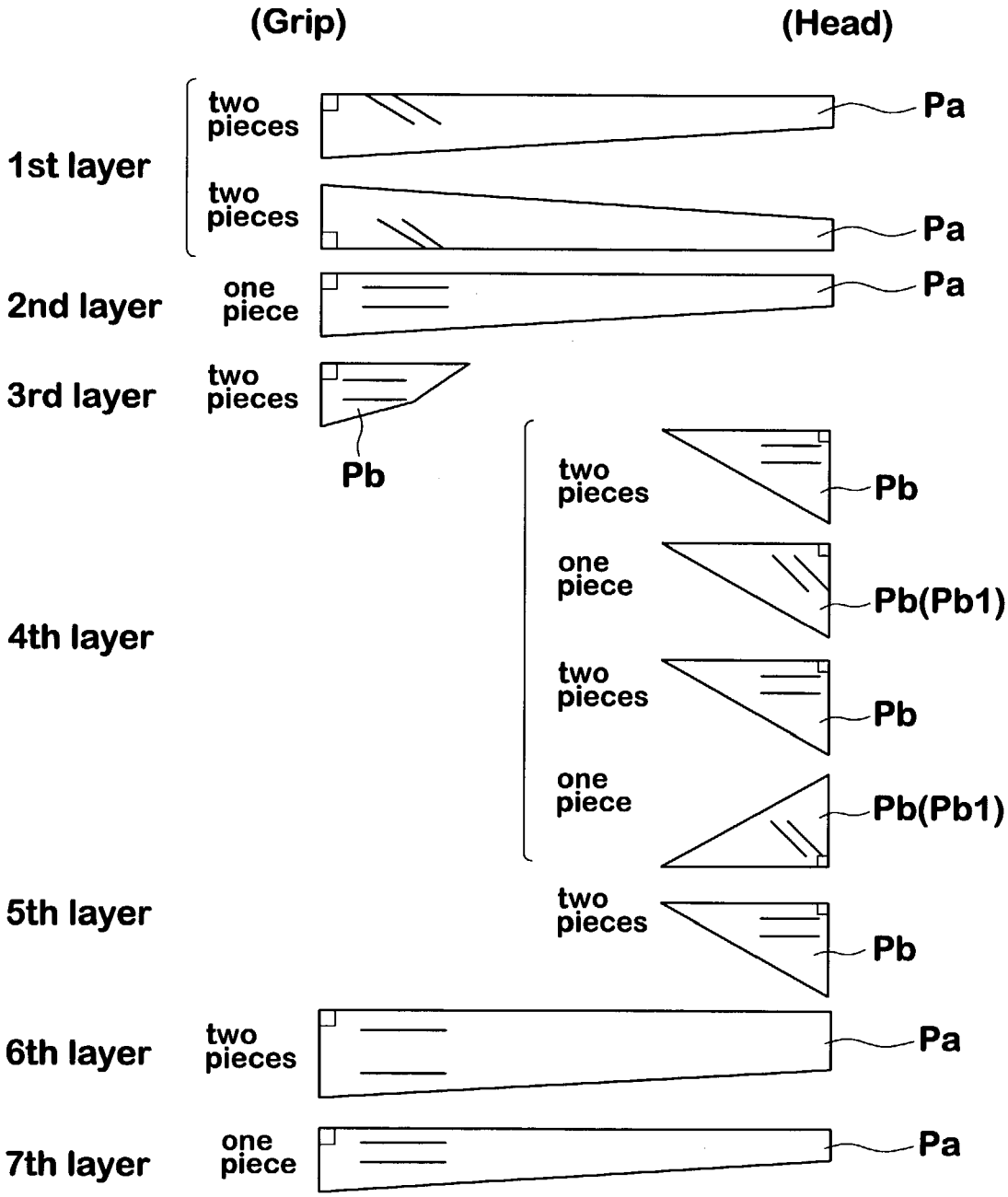
FIG. 6 is an exemplary set of prepreg pieces used to make the club shaft.
Figure 7:
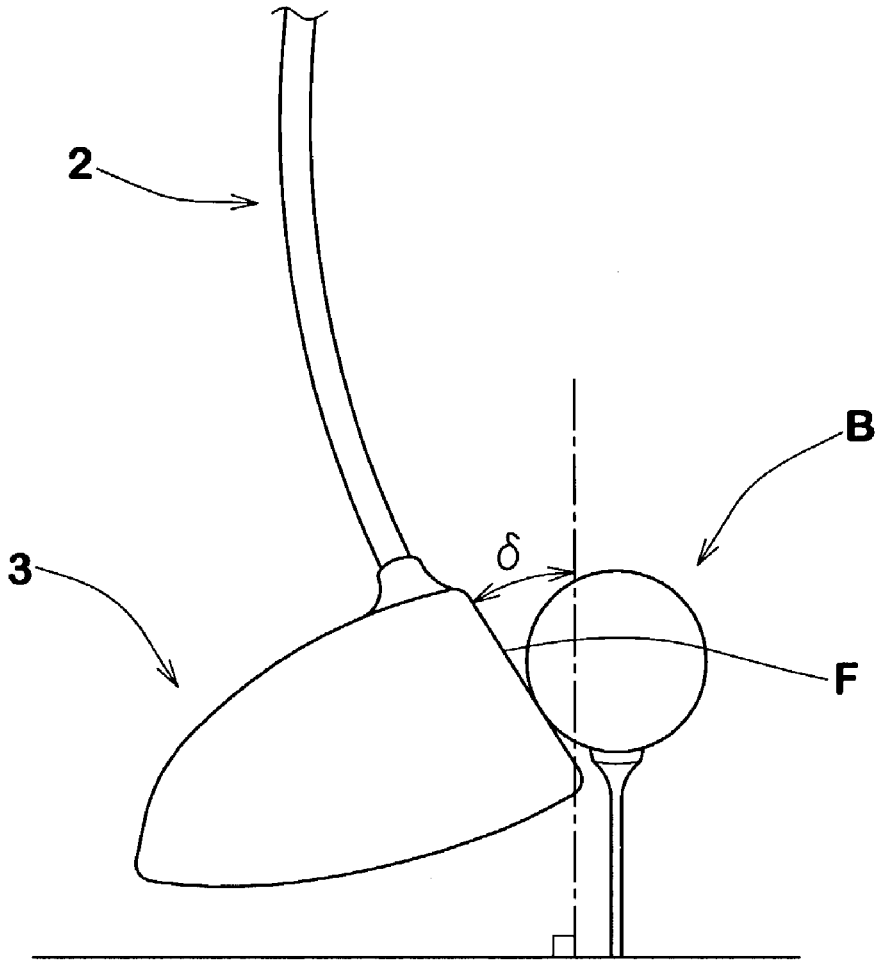
FIG. 7 is a schematic side view for explaining the dynamic loft angle.

FIG. 6 shows an exemplary set of prepreg pieces which include long pieces Pa having a length corresponding to the club shaft length, and small pieces Pb shorter than the long prepreg pieces Pa. In this figure, the orienteering direction or longitudinal direction of the carbon fibers in each prepreg piece is shown using two parallel lines.

It is preferable that a pitch-based carbon fiber prepreg whose elastic modulus is not more than 235 GPa, preferably not more than 150 GPa, more preferably 50 to 100 GPa is used in at least the above-mentioned tip end part. More specifically, at least the small pieces Pb are made of such pitch-based carbon fiber prepreg. In this embodiment, however, the long pieces Pa are also made of the same prepreg as the small pieces Pb.

In order to increase the strength in the tip end part while achieving the decreased rigidity, additional small pieces Pb1 whose fiber oriented direction is inclined at about 45 degrees with respect to the club shaft center axis CL are included in the small pieces Pb together with small pieces whose fiber oriented direction is parallel with the axis CL.

As explained above, by designing the club shaft such that the smallest flexural rigidity occurs between 0% and 40% of the club shaft length from the tip end 2*a*, the flexure of the club shaft at impact is improved and the dynamic loft angle $\delta$ at impact is optimally increased as shown in FIG. 5.

Preferably, the position of the smallest flexural rigidity is set in a range between 10% and 30%, more preferably between 10% and 20%, and further the flexural rigidity is progressively increased from the position of the smallest flexural rigidity toward the head and grip. It is also preferable that a part where the flexural rigidity is less than 10 ($N \cdot m^2$) extends at least 10% of the shaft length.

If the smallest flexural rigidity is more than 10 $N \cdot m^2$, it becomes difficult to obtain an optimally increased dynamic loft angle $\delta$. If the smallest flexural rigidity is less than 5 $N \cdot m^2$, it is difficult to obtain the necessary strength and durability.

If the real loft angle $\alpha$ is less than 14 degrees, it is difficult for the slow head speed golfers to increase the launch angle and thus the carry. If the loft angle $\alpha$ is more than 18 degrees, the launch angle tends to increase excessively which results in undesirable high trajectory and the traveling distance decreases.

If the club head volume is less than 250 cc, the moment of inertia of the club head 3 becomes small and the club head 3 has little latitude as to miss shot and the directionality becomes worse. Further, with respect to the center of gravity G, the design freedom is suppressed. If the volume is more than 500 cc, the club head weight increases, and the handling becomes rather difficult.

If the vertical distance L between the sweet spot SS and face center Fc is less than 1 mm, the backspin decreasing effect becomes insufficient, and it is difficult to optimize the backspin. If the distance L is more than 5 mm, the gear effect becomes too much and it is difficult to obtain even a minimal backspin.

COMPARISON TESTS

Wood-type 330 cc golf club heads were made using a titanium alloy Ti-6Al-4v and attached to three types of club shafts having different flexural rigidity made using pitch-based carbon fiber prepreg having an elastic modulus of 100 GPa (E1026C-70N, Nippon Graphite Fiber KK).

Each golf club was attached to a swing robot and hit golf balls five times at the head speed of 40 m/sec. The balls used were "Maxfli Hi-Brid" ™, manufactured by Sumitomo Rubber Industry, Ltd. The initial ball velocity, launch angle, backspin, traveling distance (carry, run) of the struck ball were measured. The average for the five time hitting is shown in Table 1.

Further, to evaluate the durability of the club head, ball hitting was made 3000 times per each club at a higher head speed of 51 m/s, and then the club head was visually inspected.

The test results are shown in Table 1.

TABLE 1

| Club | | Ex.1 | Ex.2 | Ex.3 | Ex.4 | Ex.5 | Ex.6 | Ex.7 | Ref.1 | Ref.2 | Ref.3 | Ref.4 | Ref.5 | Ref.6 |
|---|---|---|---|---|---|---|---|---|---|---|---|---|---|---|
| Club head | | | | | | | | | | | | | | |
| Loft angle α | (deg.) | 14 | 16 | 17 | 18 | 17 | 17 | 17 | 11 | 20 | 17 | 17 | 17 | 17 |
| Distance L | (mm) | 3 | 3 | 3 | 3 | 1.2 | 1.5 | 4 | 3 | 3 | −1 | 6 | 3 | 3 |
| Volume | (cc) | 330 | 330 | 330 | 330 | 330 | 330 | 330 | 330 | 330 | 330 | 330 | 330 | 330 |
| Club shaft | | | | | | | | | | | | | | |
| Min. flexural rigidity El | ($N\text{-}m^2$) | 8 | 8 | 8 | 8 | 8 | 8 | 8 | 8 | 8 | 8 | 8 | 10.5 | 11.5 |
| Initial velocity | (m/s) | 58.3 | 58.2 | 58.2 | 58.1 | 58.5 | 58.5 | 58.1 | 58.4 | 58 | 58.5 | 57.9 | 58 | 58.2 |
| Launch angle | (deg.) | 14.5 | 14.8 | 15.5 | 17.1 | 14.8 | 15 | 16.1 | 10.1 | 18.5 | 14.2 | 17.8 | 15.9 | 15 |
| Backspin | (rpm) | 1650 | 1822 | 1907 | 2314 | 2882 | 2443 | 1758 | 1520 | 2850 | 3849 | 1520 | 2945 | 1628 |
| Carry | (yard) | 182.3 | 188.4 | 193 | 195.6 | 190.1 | 192.3 | 194 | 166.4 | 191 | 184 | 197.5 | 192.9 | 190.1 |
| Carry + Run | (yard) | 229.2 | 230.9 | 231.3 | 228.9 | 226.7 | 229.1 | 231.2 | 224.3 | 219 | 204 | 222.2 | 222.5 | 221.4 |
| Durability * | | ok | ok | ok | ok | ok | ok | ok | ok | ok | ok | ok | ok | ok |

* All had no damage

As described above, in the golf club according to the present invention, the club head having the specific loft angle, club head volume and sweet spot position is combined with the club head having the smallest flexural rigidity in the specific position. As a result, even for the golfers whose club head speed is relatively slow such as the average golfers, it is possible to obtain an optimized ball launch angle and backspin to increase the traveling distance of the ball.

The invention claimed is:

1. A golf club comprising a club shaft and a wood-type hollow club head, the club head having a loft angle of from 14 to 18 degrees, a head volume of not less than 250 cc, and a sweet spot at a vertical distance of from 1 to 5 mm downwards of a face center, and the club shaft having a tip end connected to the club head and a butt end on which a grip is disposed, and having a variable flexural rigidity with a minimum in a range of from 5 to 10 $N\cdot m^2$, wherein the minimum flexural rigidity occurs in a range between 10% and 30% of the length of the club shaft from the tip end of the club shaft, and wherein the flexural rigidity progressively increases from the position of the minimum flexural rigidity toward the tip end and the butt end such that the flexural rigidity at the tip end becomes more than 20 $N\cdot m^2$ and the flexural rigidity at the butt end becomes less than 60 $N\cdot m^2$, and a part where the flexural rigidity is less than 10 $N\cdot m^2$ extends at least 10% of the shaft length.

2. The golf club according to claim 1, wherein the club head comprises a sole portion with a wall thickness that is increased in a front edge portion thereof.

3. The golf club according to claim 1, wherein the minimum flexural rigidity occurs in a range between 10% and 20% of the length of the club shaft from the tip end of the club shaft.

4. The golf club according to claim 1, wherein the club head has a loft angle of from 15 to 17 degrees, and a head volume of more than 270 cc and less than 500 cc.

5. The golf club according to claim 1, wherein the minimum flexural rigidity is in a range of from not less than 6.5 $N\cdot m^2$ to not more than 8.5 $N\cdot m^2$.

6. The golf club according to claim 1, wherein the minimum flexural rigidity is in a range of from not less than 7.0 $N\cdot m^2$ to not more than 8.0 $N\cdot m^2$.

* * * * *